US011371738B2

(12) United States Patent
Kaiser et al.

(10) Patent No.: US 11,371,738 B2
(45) Date of Patent: Jun. 28, 2022

(54) ENCLOSURE FOR A CONTROLLER OF AN HVAC SYSTEM

(71) Applicant: Johnson Controls Technology Company, Auburn Hills, MI (US)

(72) Inventors: Cody J. Kaiser, Wichita, KS (US); Aneek M. Noor, Wichita, KS (US); Shawn A. Hern, Derby, KS (US); Tyler P. McCune, El Dorado, KS (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 250 days.

(21) Appl. No.: 16/248,634

(22) Filed: Jan. 15, 2019

(65) Prior Publication Data

US 2020/0217547 A1 Jul. 9, 2020

Related U.S. Application Data

(60) Provisional application No. 62/790,390, filed on Jan. 9, 2019.

(51) Int. Cl.

| | |
|---|---|
| ***F24F 13/20*** | (2006.01) |
| ***F24F 11/54*** | (2018.01) |
| ***F24F 11/56*** | (2018.01) |
| ***F24F 11/89*** | (2018.01) |

(52) U.S. Cl.

CPC ..... *F24F 11/54* (2018.01); *F24F 11/56* (2018.01); *F24F 11/89* (2018.01); *F24F 13/20* (2013.01); *F24F 2013/207* (2013.01)

(58) Field of Classification Search

CPC .. F24F 13/20; F24F 13/22; F24F 11/54; F24F 11/56

USPC ..... 361/600; 211/26; 220/4; 312/23.1, 248; 403/11, 164, 165, 82, 84, 190, 230, 234

See application file for complete search history.

(56) References Cited

U.S. PATENT DOCUMENTS

| | | | | |
|---|---|---|---|---|
| 4,572,569 A * | 2/1986 | HaBmann | ..... | B60N 2/3013 296/65.17 |
| 5,294,195 A * | 3/1994 | Amr | ..... | F24F 1/18 312/236 |
| 5,388,032 A * | 2/1995 | Gill | ..... | A47B 21/0314 361/679.01 |
| 5,495,887 A * | 3/1996 | Kathnelson | ..... | G05D 23/1934 165/11.1 |
| 6,345,511 B1 | 2/2002 | Esty et al. | | |
| 6,370,899 B1 | 4/2002 | Hobbs et al. | | |

(Continued)

FOREIGN PATENT DOCUMENTS

| | | |
|---|---|---|
| CN | 201273658 Y | 7/2009 |
| CN | 202998705 U | 6/2013 |

(Continued)

*Primary Examiner* — Jonathan Bradford

(74) *Attorney, Agent, or Firm* — Fletcher Yoder, P.C.

(57) ABSTRACT

A heating, ventilation, and/or air conditioning (HVAC) control system includes an enclosure having a first portion and a second portion assembled in a clamshell configuration. The first portion and the second portion are configured to hingedly engage in a closed configuration about a controller for an HVAC system and are configured to hingedly disengage into an open configuration. The HVAC control system also includes a hinge feature that is configured to hingedly couple the enclosure to a housing of the HVAC system.

26 Claims, 8 Drawing Sheets

(56) References Cited

U.S. PATENT DOCUMENTS

| | | | | |
|---|---|---|---|---|
| 6,896,343 | B1 * | 5/2005 | Jaeger | A47B 46/005 312/242 |
| 6,974,383 | B2 | 12/2005 | Lewis et al. | |
| 7,823,231 | B2 * | 11/2010 | Paoutoff | A47C 17/48 5/136 |
| 7,894,194 | B2 * | 2/2011 | Shih | G06F 3/023 361/725 |
| 7,935,888 | B2 | 5/2011 | Hansen et al. | |
| 9,730,360 | B2 | 8/2017 | Manahan et al. | |
| 2005/0173357 | A1 * | 8/2005 | McClain | H05K 7/1494 211/26 |
| 2010/0193164 | A1 | 8/2010 | Wakatsuki | |
| 2013/0127318 | A1 * | 5/2013 | Chen | B41J 29/13 312/327 |
| 2013/0137358 | A1 * | 5/2013 | Manahan | H02B 1/28 454/184 |
| 2013/0334716 | A1 * | 12/2013 | Ching | F24H 3/0411 261/81 |
| 2018/0063973 | A1 | 3/2018 | Zhong et al. | |
| 2019/0162437 | A1 * | 5/2019 | Dushane | F24F 13/20 |

FOREIGN PATENT DOCUMENTS

| | | | |
|---|---|---|---|
| CN | 203298437 | U | 11/2013 |
| CN | 203375569 | U | 1/2014 |
| CN | 203454294 | U | 2/2014 |
| CN | 203810660 | U | 9/2014 |
| CN | 203912411 | U | 10/2014 |
| CN | 203928197 | U | 11/2014 |
| CN | 204069551 | U | 12/2014 |
| CN | 204963407 | U | 1/2016 |
| CN | 106455376 | A | 2/2017 |
| CN | 206191721 | U | 5/2017 |
| CN | 107023904 | A | 8/2017 |
| CN | 107084508 | A | 8/2017 |
| CN | 207146708 | U | 3/2018 |
| CN | 107889408 | A | 4/2018 |
| EP | 1416230 | B1 | 4/2012 |
| EP | 1500882 | B1 | 10/2012 |
| EP | 3037736 | A1 | 9/2015 |
| GB | 2304400 | A | 3/1997 |

* cited by examiner

ENCLOSURE FOR A CONTROLLER OF AN HVAC SYSTEM

CROSS-REFERENCE TO RELATED APPLICATIONS

This application claims priority from and the benefit of U.S. Provisional Application Ser. No. 62/790,390, entitled "ENCLOSURE FOR A CONTROLLER OF AN HVAC SYSTEM," filed Jan. 9, 2019, which is herein incorporated by reference in its entirety for all purposes.

BACKGROUND

This disclosure relates generally to heating, ventilation, and/or air conditioning (HVAC) systems. Specifically, the present disclosure relates to an enclosure for a controller of an HVAC system.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light and not as an admission of any kind.

A heating, ventilation, and/or air conditioning (HVAC) system may be used to thermally regulate an environment, such as a building, home, or other structure. The HVAC system generally includes a vapor compression system having heat exchangers, such as a condenser and an evaporator, which cooperate to transfer thermal energy between the HVAC system and the environment. Particularly, a compressor may be used to circulate a refrigerant through the vapor compression system and enable the transfer of thermal energy between the condenser and the evaporator. The HVAC system typically includes a controller or other control device that is configured to monitor and/or control operation of various HVAC components included in the HVAC system. For example, the controller may adjust operational parameters of the compressor, one or more fans or blowers, various dampers or flow regulators, and/or any other suitable HVAC components of the HVAC system. In some cases, the controller may be exposed to ambient environmental elements, including moisture or airborne particulates, such as dust or pollen. Unfortunately, repeated exposure of the controller to such foreign elements may cause the controller to degrade and operate less effectively.

SUMMARY

The present disclosure relates to a heating, ventilation, and/or air conditioning (HVAC) control system having an enclosure that includes a first portion and a second portion assembled in a clamshell configuration. The first portion and the second portion are configured to hingedly engage in a closed configuration about a controller for an HVAC system and are configured to hingedly disengage into an open configuration. The HVAC control system also includes a hinge feature that is configured to hingedly couple the enclosure to a housing of the HVAC system.

The present disclosure also relates to an enclosure for a controller of a heating, ventilation, and/or air conditioning (HVAC) system. The enclosure includes a receptacle having a chamber configured to receive the controller, and a cover that is pivotably coupled to the receptacle via a hinge feature, such that the receptacle and the cover are configured to pivotably engage in a closed configuration to enclose the controller and seal the controller within the chamber and are configured to pivotably disengage to an open configuration to expose the controller. The hinge feature is configured to pivotably couple the receptacle and the cover to a housing of the HVAC system.

The present disclosure also relates to a heating, ventilation, and/or air conditioning (HVAC) unit having a controller configured to manage operation of the HVAC unit. The HVAC unit includes an enclosure having a receptacle that is configured to receive and support the controller. The enclosure also includes a cover that is hingedly coupled to the receptacle, where the receptacle and the cover are configured to rotate relative to one another between a closed configuration to encapsulate the controller within the receptacle and the cover and an open configuration to expose the controller. The HVAC unit also includes a hinge feature that is configured to hingedly couple the enclosure to frame rails of the HVAC unit.

BRIEF DESCRIPTION OF THE DRAWINGS

Various aspects of this disclosure may be better understood upon reading the following detailed description and upon reference to the drawings in which.

DETAILED DESCRIPTION

Figure 1:
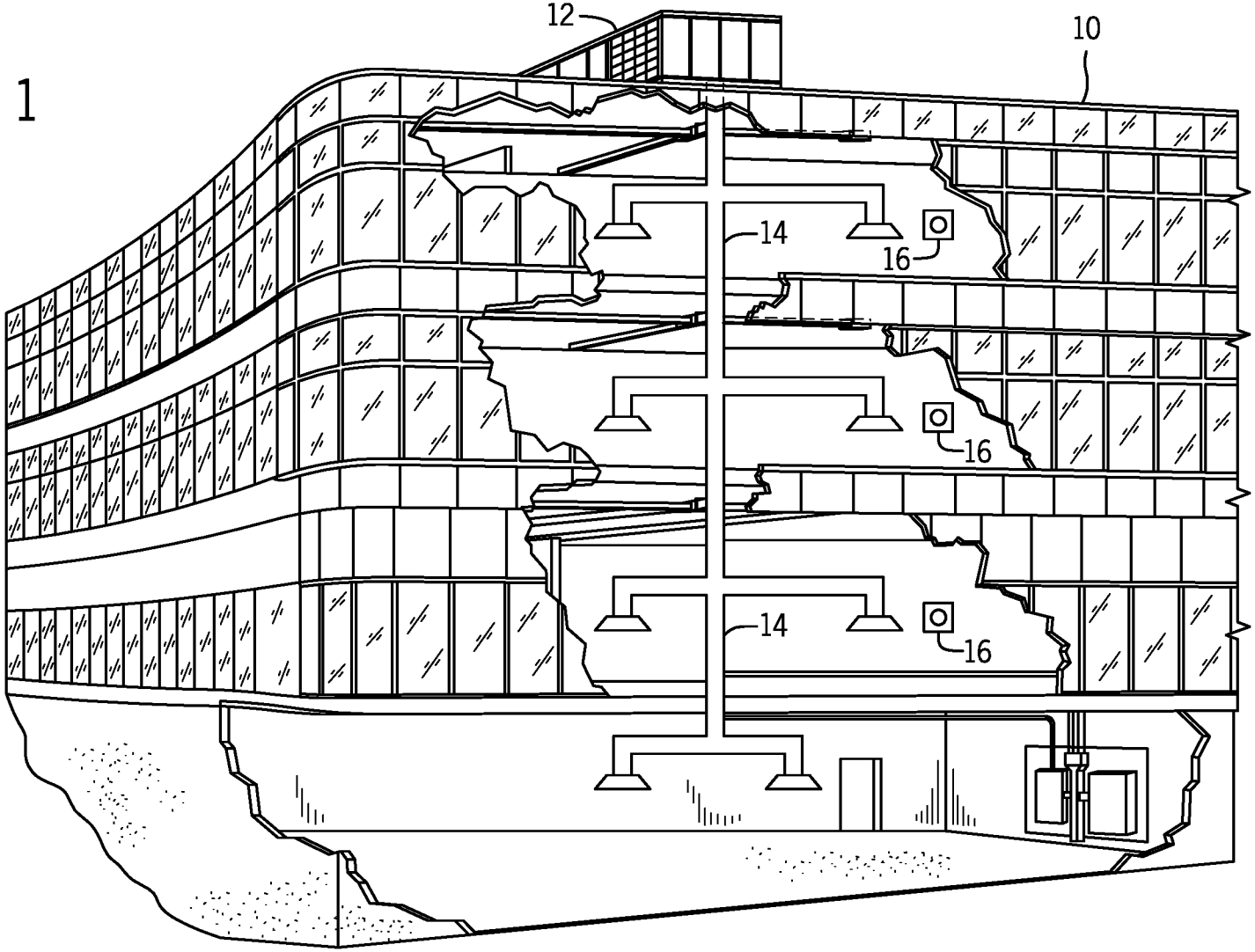
FIG. 1 is a perspective view of an embodiment of a building that may utilize a heating, ventilation, and/or air conditioning (HVAC) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As briefly discussed above, a heating, ventilation, and/or air conditioning (HVAC) system may be used to thermally regulate a space within a building, home, or other suitable structure. The HVAC system generally includes a vapor compression system that transfers thermal energy between a heat transfer fluid, such as a refrigerant, and a fluid to be conditioned, such as air. The vapor compression system typically includes a condenser and an evaporator that are fluidly coupled to one another via a conduit to form a refrigerant circuit. A compressor of the refrigerant circuit may be used to circulate the refrigerant through the conduit and enable the transfer of thermal energy between the condenser and the evaporator.

In many cases, a controller or other control device may be used monitor and/or control operation of certain climate management components included in the HVAC system, such as the compressor. For example, one or more control transfer devices, including wires, cables, and the like, may be used to operatively couple the controller to the climate management components of the HVAC system and enable the controller to adjust operational parameters of these components. In certain cases, the controller may be exposed to foreign elements, such as dust, pollen, or other airborne particulates, which may accumulate on the controller over time. Further, in some cases, the controller may be positioned exterior of a housing of the HVAC system and, as a result, may be exposed to precipitation, snowfall, ultraviolet radiation, and/or other environmental elements surrounding the HVAC system. Repeated exposure to such foreign and environmental elements may cause to controller to incur wear and operate less effectively over time.

Accordingly, typical HVAC systems may include a controller enclosure that is configured to cover the controller to reduce exposure of the controller to such elements. Unfortunately, conventional controller enclosures may be unable to effectively block substantially all contaminants from entering the enclosure. For example, conventional controller enclosures may include seams or gaps that may allow contaminants to penetrate into an interior of the enclosure and potentially interact with the controller. Moreover, removal of typical controller enclosures to uncover or expose the controller for maintenance, inspection, or other purposes may be difficult and time consuming, thereby increasing a time period that may be involved in obtaining access to the controller to perform such activities.

It is now recognized that substantially isolating the controller from exposure to foreign contaminants and various environmental elements may reduce wear on the controller and enhance an operational life of the controller. Specifically, it is now recognized that substantially shielding the controller from exposure to weather conditions or airborne particulates may enable the controller to operate effectively for a prolonged period of time. Additionally, it is now recognized that facilitating access to the controller may reduce a time period involved in performing maintenance on the controller and therefore reduce overall costs associated with HVAC system maintenance.

With the foregoing in mind, embodiments of the present disclosure are directed toward an enclosure, referred to herein as a controller enclosure, which, in a closed configuration, may substantially isolate a controller or other control device of the HVAC system from exposure to the aforementioned foreign contaminants. In addition, the controller enclosure is configured to rapidly transition between the closed configuration, where the controller is substantially encapsulated and shielded from the ambient environment, and an open configuration, where the controller is exposed and accessible for inspection.

For example, as discussed in detail below, the controller enclosure may include a first portion, referred to herein as a receptacle, and a second portion, referred to herein as a cover, which are hingedly or pivotably coupled to one another via a hinge feature. The receptacle may include a chamber formed therein, which is configured to house the controller of the HVAC system. To transition the controller enclosure to the closed configuration, the receptacle and the cover may rotate about the hinge feature and toward one another until the receptacle engages with the cover. Engagement between the receptacle and the cover may provide a fluid seal between the receptacle and the cover that substantially seals the chamber, and thus the controller positioned therein, from exposure to the ambient environment. To re-enable access to the controller within the enclosure, the receptacle may rotate apart from the cover to transition the controller enclosure to the open configuration. As discussed in detail below, the hinge feature may also be configured to hingedly couple the controller enclosure to frame rails of an HVAC unit included in the HVAC system. The hinge features may enable the controller enclosure to rotate relative to the frame rails between an operational orientation, where the controller enclosure extends substantially parallel to the frame rails, and a transverse orientation, where the controller enclosure extends generally orthogonal to the frame rails. These and other features will be described below with reference to the drawings.

It is important to note that, while the present disclosure describes the controller enclosure as configured to isolate a controller from elements or contaminants typically encountered in an HVAC setting, it should be appreciated that the disclosed embodiments may be implemented to isolate a controller or other electronic device from exposure to a variety of other foreign contaminants or elements that may be encounter in various industrial settings. For example, the techniques described herein may be used to protect certain controller(s) or electronic device(s) from exposure to chemicals, petroleum products, corrosive fumes, large temperature fluctuations, or any other environmental elements that may cause such controller(s) and electronic device(s) to incur wear.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
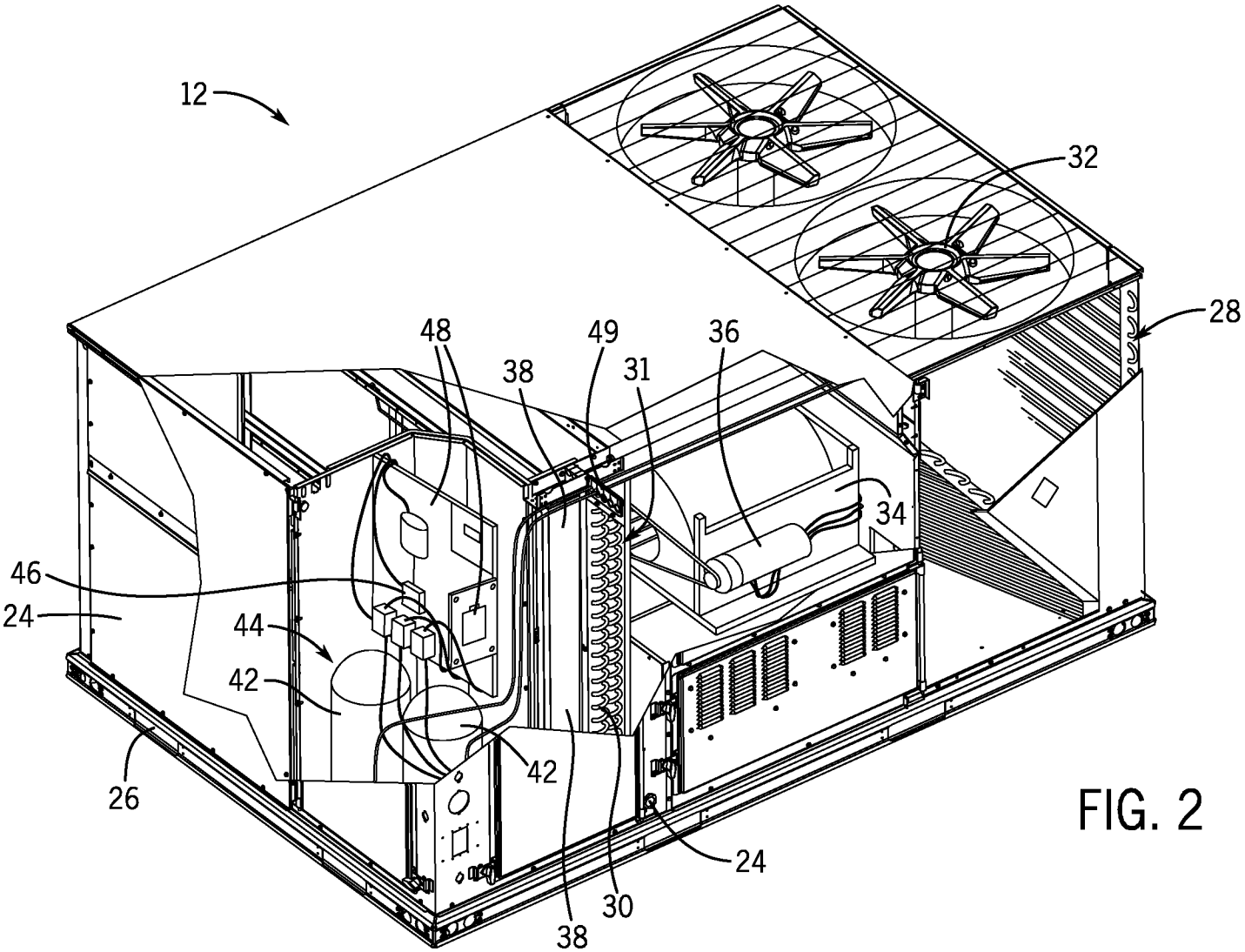
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 or enclosure encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
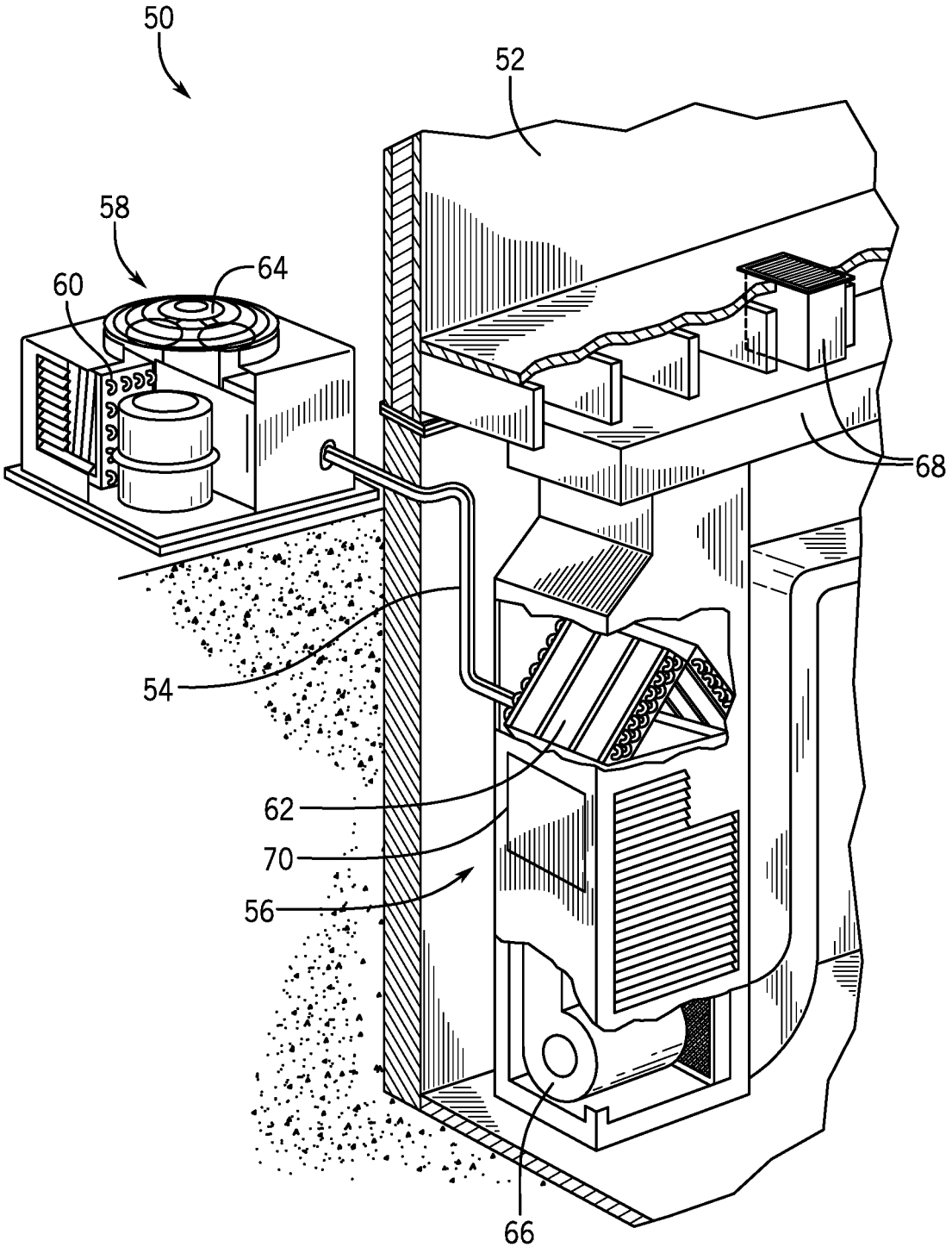
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
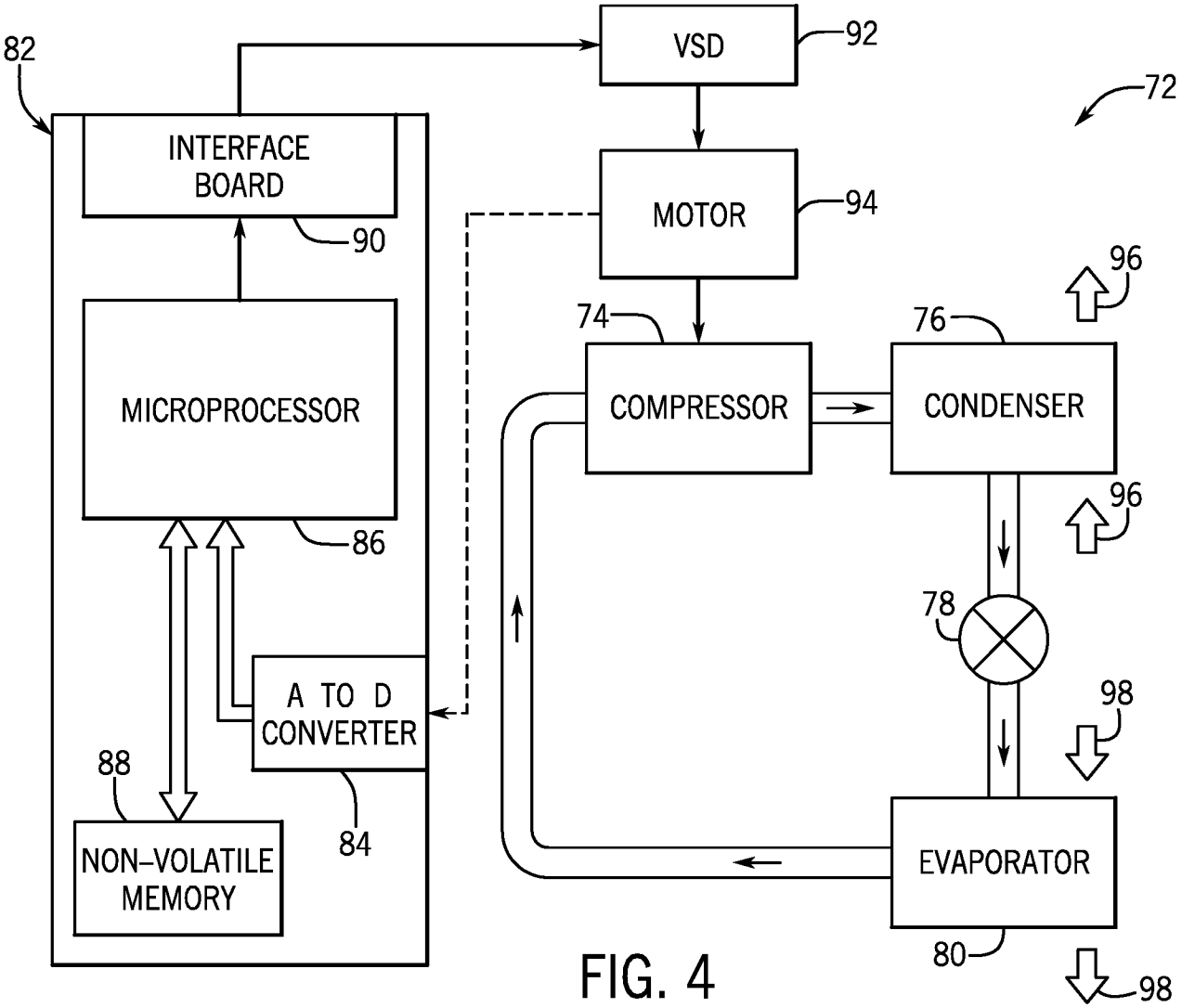
FIG. 4 is a schematic diagram of an embodiment of a vapor compression system that may be used in an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As noted above, HVAC systems generally include one or more control devices, such as the control board 48 or the control panel 82, which may be configured to control and/or monitor operation of various climate management components included in the HVAC system. In many cases, it may be desirable to shield such control devices from exposure to moisture, airborne particulates, or other foreign elements that may accumulate within or near the control devices. Particularly, it may be desirable to provide such protection to control devices that may be positioned exterior to a housing of the HVAC system or that may be incorporated with an HVAC system positioned in an external or ambient environment. Indeed, control devices positioned exterior to the HVAC housing may experience direct exposure to precipitation, snowfall, ultraviolet radiation, and/or other environmental elements that may cause the control devices to degrade over time. Accordingly, embodiments of the present disclosure are directed to an enclosure that is configured to substantially shield an HVAC controller or other control device from exposure to such contaminants and elements.

Figure 5:
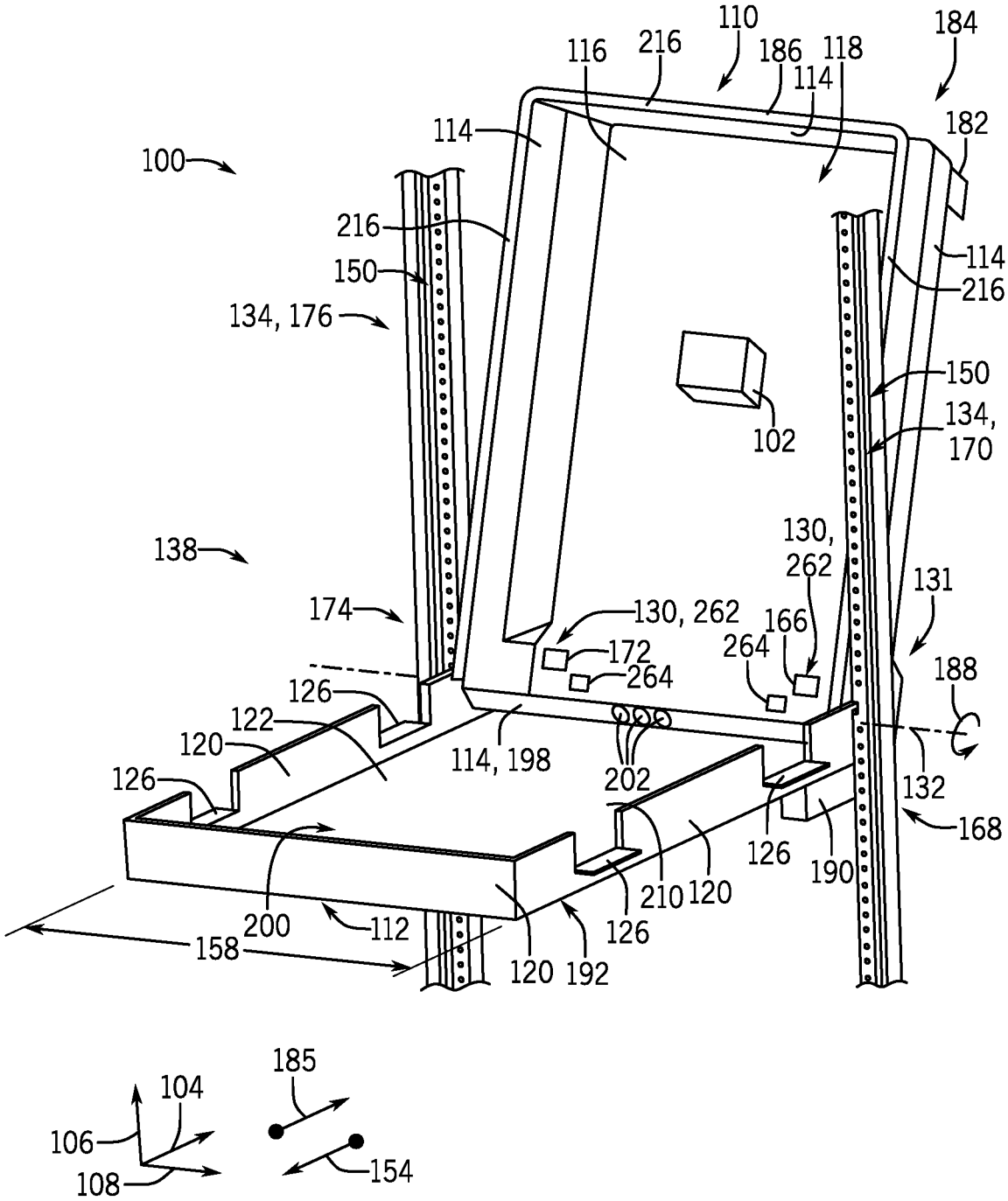
FIG. 5 is a perspective view of an embodiment of a controller enclosure in an open configuration, in accordance with an aspect of the present disclosure.

For instance, FIG. 5 is a perspective view of an embodiment of a controller enclosure 100 that may be configured to substantially enclose a control unit 102, such as one or more controllers, control boards, and/or control panels, of an HVAC system to shield the control unit 102 from exposure to moisture and/or other foreign elements. The controller enclosure 100 may be included in embodiments or components of the HVAC unit 12 shown in FIG. 2, embodiments or components of the split, residential heating and cooling system 50 shown in FIG. 3, a rooftop unit (RTU), or any other suitable HVAC system. Accordingly, it should be appreciated that the control unit 102 may include the control board 48, the control panel 82, and/or any other suitable control device(s) or HVAC component(s) that may be secured within the controller enclosure 100. To facilitate discussion, the controller enclosure 100 and its components will be described with reference to a longitudinal axis 104, a vertical axis 106, which is oriented relative to gravity, and a lateral axis 108.

As shown in the illustrated embodiment, the controller enclosure 100 includes a first portion or a first case, referred to herein as a receptacle 110, and a second portion or a second case, referred to herein as a cover 112, which collectively form the controller enclosure 100. The receptacle 110 includes a plurality of walls 114 that extend from a base portion 116 of the receptacle 110 and may form a perimeter or outer wall of the receptacle 110. In some embodiments, the walls 114 may extend generally orthogonal to the base portion 116. However, in other embodiments, one or more of the walls 114 may extend at an oblique angle from the base portion 116. In any case, the walls 114 and the base portion 116 may collectively form a chamber 118 of the receptacle 110 that is configured to receive the control unit 102. The control unit 102 may be coupled to the base portion 116, the walls 114, or both, via suitable fasteners, such as screws, friction pins, rivets, snap-connectors, or the like, and/or adhesives, such as bonding glue. Accordingly, the control unit 102 may be positioned within the chamber 118 and may be supported by the base portion 116 and/or the walls 114. In other embodiments, any other suitable fastener(s) or fastening technique(s) may be used to couple the control unit 102 to the receptacle 110. Moreover, in certain embodiments, the control unit 102 may be coupled to the cover 112 instead of the receptacle 110.

Figure 8:
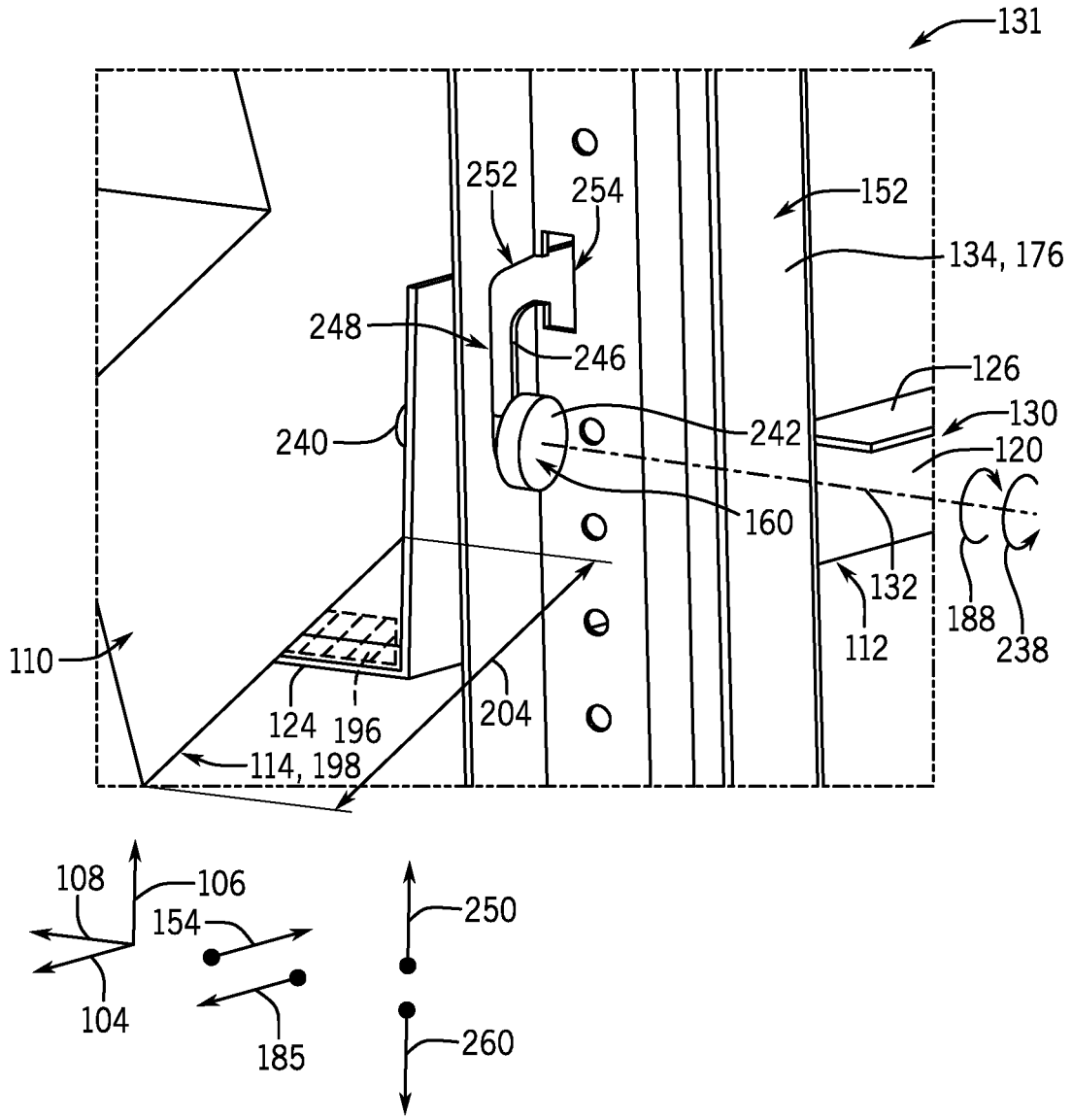
FIG. 8 is a perspective view of an embodiment of a hinge assembly of a controller enclosure, in accordance with an aspect of the present disclosure.

Similar to the plurality of walls 114 of the receptacle 110, the cover 112 may include a plurality of panels 120 that extend from a base portion 122 of the cover 112 at an orthogonal angle or an oblique angle to the base portion 122. In some embodiments, the panels 120 may extend about a perimeter of the base portion 122 and, thus, form a perimeter of the cover 112. In other embodiments, the panels 120 may extend partially about the perimeter of the base portion 122, such that the base portion 122 includes an exposed edge 124, as shown in FIG. 8, which does not include a panel 120 extending therefrom. Further, as discussed in detail below, the panels 120 may include one or more flanges 126 extending therefrom, which may facilitate retention of the controller enclosure 100 in particular orientations.

The receptacle 110 and the cover 112 may be rotatably or hingedly coupled to one another at a hinge point 131 of the receptacle 110 and the cover 112 via one or more hinge features 130. The hinge features 130 may enable the receptacle 110 and the cover 112 to rotate relative to one another about an axis 132 that extends generally parallel to the lateral axis 108. The hinge features 130 may also hingedly couple the receptacle 110 and the cover 112 to support rails 134 of the HVAC unit 12, such as frame rails of the cabinet 24, which are configured to support the controller enclosure 100. Particularly, the hinge features 130 may enable the receptacle 110 and the cover 112 to rotate individually or synchronously about the axis 132 relative to the support rails 134. That is, the hinge features 130 may enable the receptacle 110 and/or the cover 112 to rotate relative to the support rails 134 while simultaneously rotating relative to one another and, alternatively, enable the receptacle 110 and the cover 112 to remain stationary relative to one another while collectively rotating about the axis 132 relative to the support rails 134. In other words, the hinge features 130 may enable the entire controller enclosure 100 and its components to rotate relative to the support rails 134.

Figure 6:
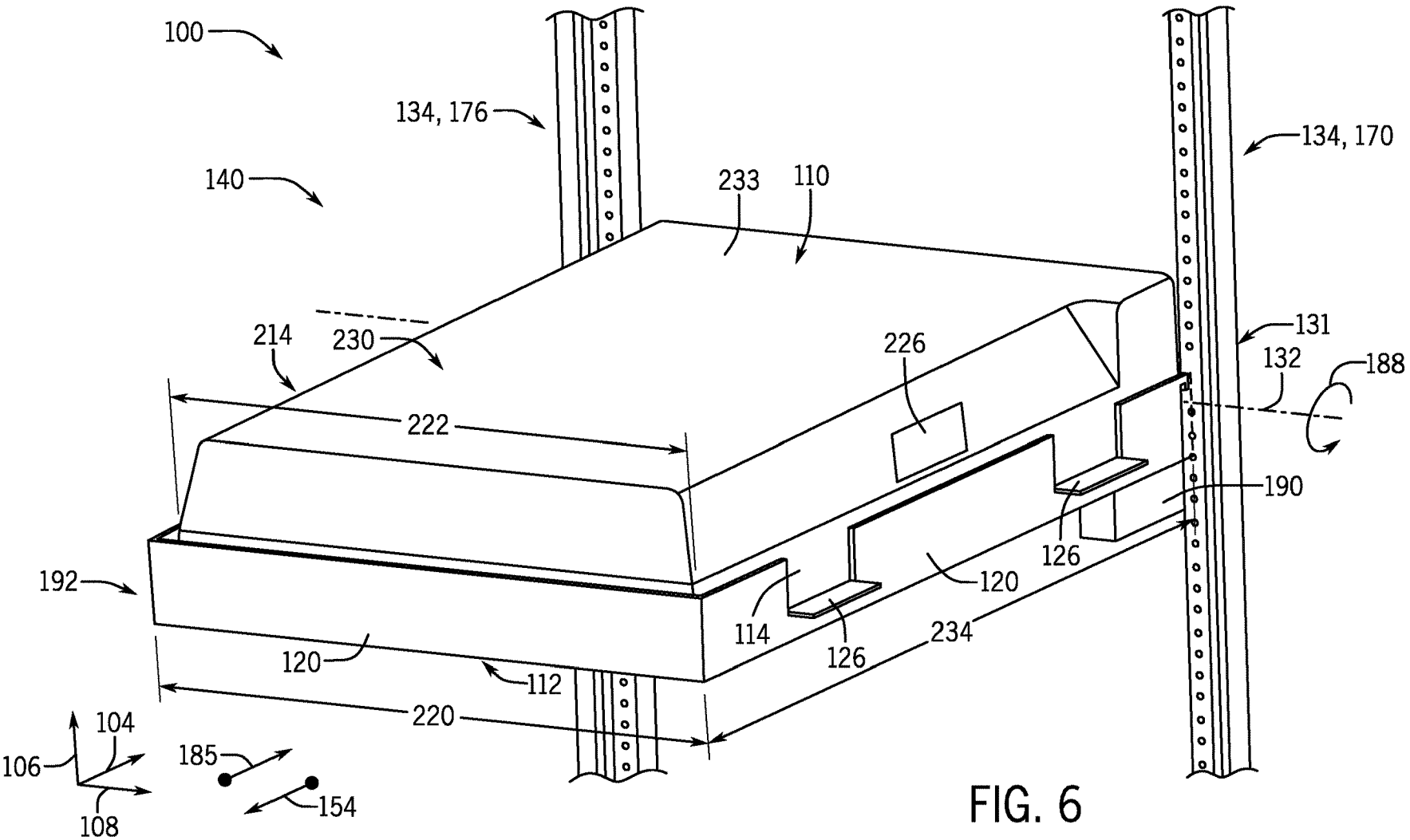
FIG. 6 is a perspective view of an embodiment of a controller enclosure in a closed configuration, in accordance with an aspect of the present disclosure.
Figure 7:
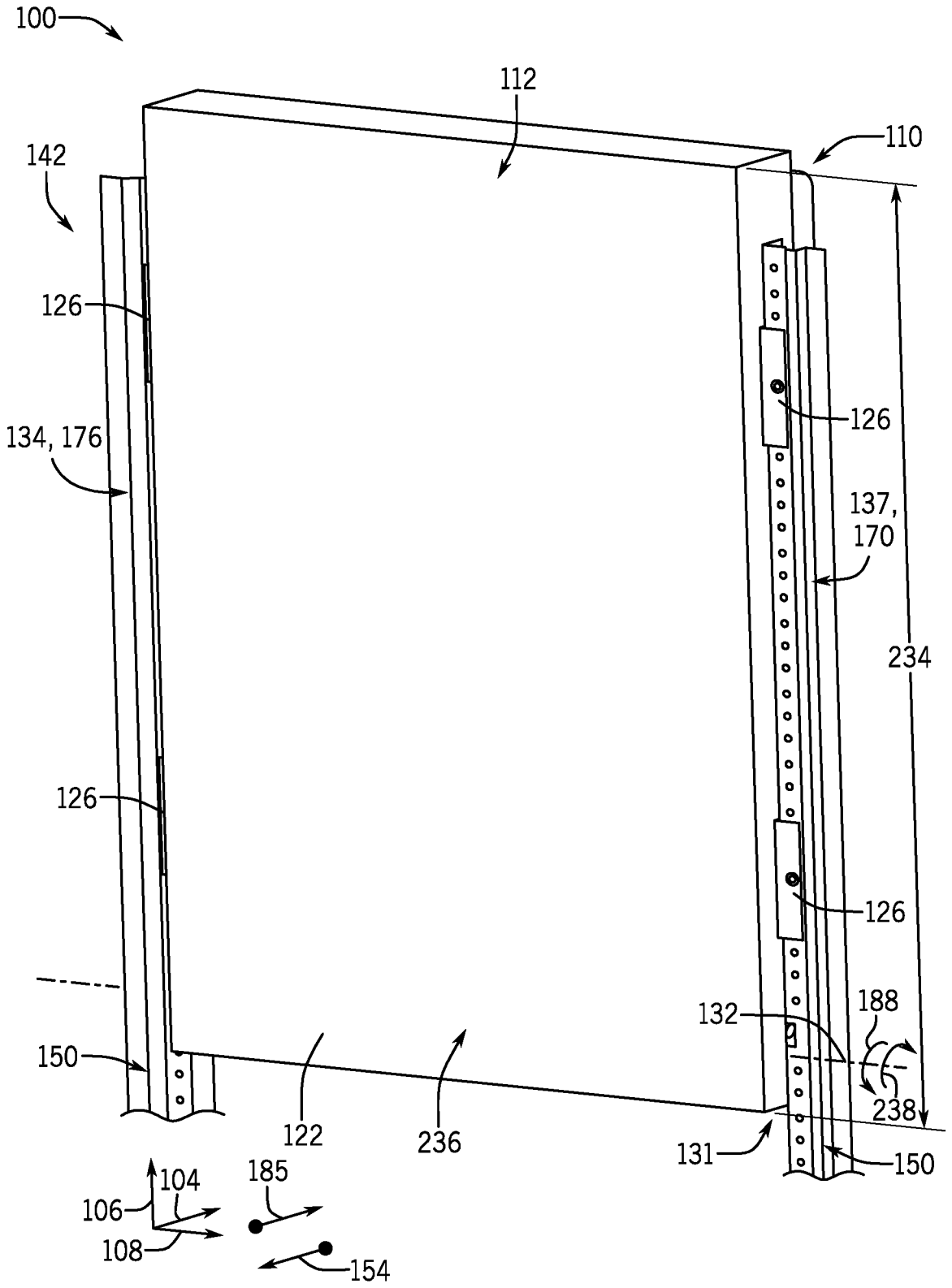
FIG. 7 is a perspective view of an embodiment of a controller enclosure in an operational configuration, in accordance with an aspect of the present disclosure.

As discussed in detail below, the hinge features 130 may enable the controller enclosure 100 to transition between an open configuration 138, where the control unit 102 is exposed to facilitate inspection and/or maintenance of the control unit 102, a closed configuration 140, as shown in FIG. 6, where the controller enclosure 100 encapsulates the control unit 102 and extends generally transverse from the support rails 134, and an operational configuration 142, as shown in FIG. 7, where the controller enclosure 100 is oriented substantially parallel to the support rails 134 while encapsulating the control unit 102. For clarity, the support rails 134 may include first end surfaces 150 that may face an exterior of the HVAC unit 12, while second end surfaces 152, as shown in FIG. 8, of the support rails 134, which are opposite the first end surfaces 150, may face an interior of the HVAC unit 12. Accordingly, in the illustrated embodiment of FIG. 5, the cover 112 extends along a transverse direction 154 away from an interior of the HVAC unit 12 when the cover 112 is in the open configuration 138. For example, the transverse direction 154 may extend generally orthogonal to the support rails 134 and may extend generally parallel to the longitudinal axis 104.

In some embodiments, the hinge feature 130 may include a pin 160, as shown in FIG. 8, which extends across a width 158 of the controller enclosure 100 and spans between the supports rails 134. In particular, the pin 160 may extend through the receptacle 110 and the cover 112 along the axis 132 and may be rotatably coupled to the support rails 134, the receptacle 110, the cover 112, or a combination thereof. In this manner, the pin 160 may enable rotational motion of the receptacle 110 and the cover 112 about the axis 132. As a non-limiting example, in certain embodiments, the pin 160 may be rigidly coupled to the receptacle 110 and may be rotatably coupled to the cover 112 and the support rails 134. Accordingly, the pin 160 and the receptacle 110 may rotate about the axis 132 as an assembly and, therefore, may rotate collectively relative to the cover 112 and the support rails 134. In such an example, the cover 112 may rotate about the axis 132 independently of the receptacle 110 and the pin 160. In other embodiments, the pin 160 may be rigidly coupled to the cover 112 and may be rotatably coupled to the receptacle 110 and the support rails 134. In such embodiments, the pin 160 and the cover 112 may rotate about the axis 132 as an assembly, while the receptacle 110 may rotate about the axis 132 independently of the cover 112 and the pin 160. In further embodiments, the pin 160 may be rotatably coupled to the receptacle 110, the cover 112, and the support rails 134, such that the pin 160 may rotate about the axis 132 independently of the receptacle 110, the cover 112, and the support rails 134.

Although the receptacle 110 and the cover 112 have been described as rotatably or pivotably coupled to the support rails 134 via the pin 160, in other embodiments, multiple pins may be used to rotatably couple the receptacle 110 and the cover 112 to the support rails 134. For example, in some embodiments, the hinge feature 130 may include a first pin 166 that is configured to rotatably couple a first side portion 168 of the controller enclosure 100 to a first support rail 170 of the support rails 134. That is, the first pin 166 may rotatably couple the receptacle 110 and the cover 112 to the first support rail 170. Similarly, a second pin 172 of the hinge feature 130 may be used to rotatably couple a second side portion 174 of the controller enclosure 100 to a second support rail 176 of the support rails 134. In other words, the second pin 172 may rotatably couple the receptacle 110 and the cover 112 to the second support rail 176. In other embodiments, any suitable hinge feature 130 or combination of hinge features 130 may be used to rotatably couple the controller enclosure 100 to the support rails 134.

As shown in the illustrated embodiment, in the open configuration 138 of the controller enclosure 100, the receptacle 110 may abut a contact point 182 of the HVAC unit 12 that is configured to maintain an angular orientation of the receptacle 110 with respect to the support rails 134. For example, in some embodiments, the contact point 182 may be positioned such that engagement between the receptacle 110 and the contact point 182 orients the receptacle 110 in a slanted position 184. Particularly, in the slanted position 184, the receptacle 110 may diverge from the support rails 134 along a reverse direction 185, opposite the transverse direction 154, from the hinge point 131 to a distal end 186 of the receptacle 110. As a result, gravity may maintain the engagement between the receptacle 110 and the contact point 182 and ensure that the receptacle 110 does not rotate about the axis 132 in a counter-clockwise direction 188.

As a non-limiting example, the contact point 182 may include a portion of the cabinet 24 of the HVAC unit 12, a support frame of the HVAC unit 12, a rubber or polymeric stopper coupled to the HVAC unit 12, and/or any other suitable portion or component of the HVAC unit 12 that is configured to contact the receptacle 110 and support the receptacle 110 in a particular orientation. However, it should be appreciated that, in other embodiments, suitable fasteners may be used to temporarily couple the receptacle 110 to the support rails 134 or to another suitable component of the HVAC unit 12 while the controller enclosure 100 is in the open configuration 138. Accordingly, the fasteners may ensure that the receptacle 110 remains oriented in the slanted position 184 while the controller enclosure 100 is in the open configuration 138. In certain embodiments, the receptacle 110 may be configured to extend generally parallel to the support rails 134 in the slanted position 184 or may be oriented at any other suitable angle with respect to the support rails 134 in the slanted position 184.

In the open configuration 138 of the controller enclosure 100, one or more support features 190 may be configured to support the cover 112 in a lateral position 192, in which the cover 112 extends generally cross-wise or orthogonal to the support rails 134. In some embodiments, the support features 190 may be coupled to the first support rail 170, the second support rail 176, or both, and may be configured to block rotational motion of the cover 112 in the counter-clockwise direction 188 about the axis 132 beyond a particular angular orientation. As a non-limiting example, the support features 190 may each include a rubber or polymeric piece of material that is coupled to the support rails 170, 176 and is configured to engage with the base portion 122 of the cover 112 to block rotational motion of the cover 112 about the axis 132. It should be noted that, in other embodiments, the cover 112 may extend at any suitable angle relative to the support rails 134 in the lateral position 192. Moreover, in certain embodiments, the support features 190 may include a variety of other support structures or support mechanisms that are configured to maintain an angular orientation of the cover 112 when the controller enclosure 100 is in the open configuration 138. For example, the support feature(s) 190 may include one or more removable support braces or suspension wires that are configured to extend from the cover 112 to a portion of the support rails 134 to retain the cover 112 in the lateral position 192. In other embodiments, any one or combination of support braces, retractable legs, suspension cables, magnetic latches, or the like, may be configured to extend between the cover 112 and component(s) of the HVAC unit 12 to support the cover 112 in the lateral position 192.

In some embodiments, the cover 112 may be configured to retain the receptacle 110 in the slanted position 184 in addition to, or in lieu of, the contact point 182. For example, in certain embodiments, the cover 112 may include a lip 196, as shown in FIG. 8, such as one of the panels 120 of the cover 112, which may be configured to engage with the receptacle 110 and block rotational motion of the receptacle 110 past a particular angular orientation. More specifically, the lip 196 may be sized such that an obtuse angle is formed between the base portion 116 of the receptacle 110 and the base portion 122 of the cover 112 when a proximal wall 198 of the receptacle 110 engages with the lip 196 in the open configuration 138 of the controller enclosure 100. Accordingly, gravity may maintain engagement between the lip 196 and the proximal wall 198, thereby retaining the receptacle 110 in the slanted position 184. In further embodiments, the controller enclosure 100 may include removable support braces that are configured to extend between the receptacle 110 and the cover 112 to retain the receptacle 110 in the slanted position 184. Indeed, it should be appreciated that various other support structures or support mechanisms may be used to retain the receptacle 110 in the slanted position 184 and to retain the cover 112 in the lateral position 192 when the controller enclosure 100 is in the open configuration 138.

As shown in the illustrated embodiment, the receptacle 110 may support the control unit 102 above the cover 112, with respect to gravity, when the controller enclosure 100 is positioned in the open configuration 138. Advantageously, the controller enclosure 100 may therefore allow ample access to the control unit 102 while in the open configuration 138 and, thus, facilitate maintenance or other operations on the control unit 102. In the open configuration 138 of the controller enclosure 100, the cover 112 may provide a work surface 200, which may include a portion of the base portion 122, and which extends transverse from the support rails 134. Indeed, the substantially planar base portion 122 of the cover 112 in the open configuration 128 may provide ample space to support equipment that may be used to install, maintain, and/or inspect the control unit 102. The cover 112 may also include features, such as pockets, straps, mounts, sleeves, and so forth, which enable a service technician or other operator to store fasteners, tools, or other items within the cover 112. By facilitating the storage of fasteners and/or tools proximate to the control unit 102, the controller enclosure 100 may facilitate installation, maintenance, and/or servicing operations on the control unit 102 and thereby reduce a time period that may be involved to perform such operations on the control unit 102.

In some embodiments, the receptacle 110 may include a plurality of openings 202 that are formed within the proximate wall 198 of the receptacle 110 and are configured to receive wires and/or control cables of the control unit 102. Particularly, the openings 202 may be formed within a projection portion 204, as shown in FIG. 8, of the proximate wall 198. For clarity, the projection portion 204 of the proximate wall 198 may include a portion of the proximate wall 198 that protrudes past the exposed edge 124 or the lip 196, as shown in FIG. 8, of the cover 112 when the controller enclosure 100 is in the open configuration 138. Accordingly, the openings 202 may enable suitable wires to extend through the receptacle 110 and to couple to a designated component of the HVAC unit 12. Advantageously, positioning the openings 202 near the hinge point 131 of the controller enclosure 100 may mitigate movement of the openings 202 relative to the support rails 134 when the controller enclosure 100 transitions between the open configuration 138, the closed configuration 140, and the operational configuration 142. Accordingly, a relatively small amount of slack in the wires of the control unit 102 may be sufficient to accommodate for the positional changes of the openings 202 between the open configuration 138, the closed configuration 140, and the operational configuration 142 of the controller enclosure 100. In some embodiments, a sealant, such as rubber resin or silicone, may be used to form a fluid seal between the openings 202 and the wires extending therethrough. In other embodiments, suitable wire connectors, gaskets, grommets, or bulkhead connectors may be disposed about the wires and coupled to the openings 202 to substantially block fluid flow through interstitial spaces between the openings 202 and wires.

In some embodiments, a gasket 210 may be disposed within the cover 112 and may be configured to form a fluid seal between the walls 114 of the receptacle 110 and the base portion 122 of the cover 112 when the controller enclosure 100 is in the closed configuration 140. The gasket 210 may be formed from foam, rubber, cork, polymeric materials, or any other suitable material that facilitates generation of a fluid seal between the cover 112 and the receptacle 110. Accordingly, in the closed configuration 140 of the controller enclosure 100, the gasket 210 may facilitate substantial isolation of the chamber 118 from the ambient environment, which may substantially shield the control unit 102 from exposure to foreign elements, such as moisture and/or airborne particulates. For example, in some embodiments, the gasket 210 may extend across substantially all of the base portion 122 of the cover 112, as shown in the illustrated embodiment of FIG. 5. In other embodiments, the gasket 210 may be disposed along a portion of the base portion 122 that engages with the walls 114 of the receptacle 110 when the receptacle 110 transitions to a closed position or a clasping position 214, as shown in FIG. 6. In some embodiments, one or more of the walls 114 may include a respective flange 216 extending therefrom, which is configured to increase a contact area between the gasket 210 and the walls 114 when the receptacle 110 is in the clasping position 214. In this manner, the flanges 216 may facilitate formation of a fluid seal between the cover 112 and the walls 114 of the receptacle 110. In certain embodiments, the gasket 210 may be coupled to the flanges 216 of the walls 114 instead of to the base portion 122 of the cover 112.

To better illustrate the hingedly actuatable engagement between the receptacle 110 and the cover 112, FIG. 6 is a perspective view of an embodiment of the controller enclosure 100 in the closed configuration 140. As shown in the illustrated embodiment, an interior width 220 extending between opposing panels 120 of the cover 112 may exceed an exterior width 222 extending between opposing walls 114 of the receptacle 110. Accordingly, the cover 112 may be configured to receive the receptacle 110 when the receptacle 110 transitions from the slanted position 184 to the clasping position 214. That is, the cover 112 may be configured to receive the receptacle 110 when the controller enclosure 100 transitions from the open configuration 138 to the closed configuration 140. In some embodiments, the controller enclosure 100 may include one or more compression features 226 that may be used to retain the receptacle 110 in the clasping position 214. Specifically, the compression features 226 may be configured to apply and maintain a compressive force between the receptacle 110, the gasket 210, and the cover 112, while the controller enclosure 100 is in the closed configuration 140. Accordingly, the compression features 226 may maintain an integrity of the fluid seal provided by the gasket 210 while the controller enclosure 100 is in the closed configuration 140 and, thus, ensure that the chamber 118 is substantially sealed from the ambient environment surrounding the controller enclosure 100. In some embodiments, the compression features 226 may include fasteners or other quick-disconnect mechanisms that enable a service technician to quickly engage or disengage the compression features 226. As an example, the compression features 226 may include wingnut fasteners that may be used to removably couple the receptacle 110 to the cover 112 without the use of dedicated or specialized tools. In further embodiments, the compression features 226 may include magnetic fasteners that are configured to maintain engagement between the receptacle 110 and the cover 112. Additionally or alternatively, any one or combination of other fastening techniques may be used to removably couple the receptacle 110 to the cover 112 in the clasping position 214.

It should be noted that, in other embodiments, an exterior width extending between opposing panels 120 of the cover 112 may be less than an interior width extending between opposing walls 114 of the receptacle 110, therefore enabling the receptacle 110 to receive the cover 112 when the receptacle 110 transitions to the clasping position 214. In such embodiments, the gasket 210 may be positioned along the base portion 116 of the receptacle 110, instead of the base portion 122 of the cover 112, such that engagement between the receptacle 110 and the cover 112 may compress the gasket 210 between the panels 120 of the cover 112 and the base portion 116 of the receptacle 110. Accordingly, the cover 112 may isolate a portion of the chamber 118 having the control unit 102 from the ambient environment.

As shown in the illustrated embodiment, the receptacle 110 may include a substantially planar exterior surface 230, which extends along the transverse direction 154 when the controller enclosure 100 is in the closed configuration 140. Similar to the work surface 200 of the cover 112, the exterior surface 230 of the receptacle 110 may provide a work surface 233 that extends generally orthogonal to the support rails 134 when the controller enclosure 100 is in the closed configuration 140. Accordingly, a service technician may position fasteners, tools, and/or other components on the work surface 233 of the receptacle 110 while performing maintenance or other operations on the HVAC unit 12, the controller enclosure 100, or both.

As noted above, the cover 112 may include one or more flanges 126 that may extend from the panels 120 of the cover 112. In some embodiments, the flanges 126 may be integrally formed with the cover 112. For example, as shown in the illustrated embodiment, the flanges 126 may include portions of the panels 120 that are bent or deformed into the shape of the flanges 126. However, in other embodiments, the flanges 126 may be separate components that are coupled to the cover 112 via suitable adhesives and/or fasteners. In any case, the flanges 126 may be configured to retain the controller enclosure 100 in the operational configuration 142, as shown in FIG. 7, in which a length 234 of the controller enclosure 100 may be oriented substantially parallel to the support rails 134.

To better illustrate, FIG. 7 is a perspective view of an embodiment of the controller enclosure 100 in the operational configuration 142. As shown in the illustrated embodiment, the flanges 126 may engage with the support rails 134 when the controller enclosure 100 is transitioned to the operational configuration 142. In some embodiments, the flanges 126 may include apertures formed therein that are configured to align with respective mounting apertures of the support rails 134. Accordingly, suitable fasteners may be used to couple the flanges 126 to the support rails 134. In this manner, the flanges 126 may facilitate retention of the controller enclosure 100 in the operational configuration 142 between inspection intervals and/or maintenance periods of the control unit 102. It should be noted that a variety of other suitable fastening techniques may be used to couple the flanges 126 to the support rails 134. As an example, in some embodiments, magnetic fasteners may be used to removably couple the flanges 126 to the support rails 134. In any case, as shown in the illustrated embodiment, the controller enclosure 100 may be oriented substantially parallel or aligned with the support rails 134 when in the operational configuration 142. Accordingly, in some embodiments, an exterior surface 236 of the cover 112 may be substantially coplanar or aligned with the first end surfaces 150 of the support rails 134 when the controller enclosure 100 is in the operational configuration 142.

To transition the controller enclosure 100 from the operational configuration 142 to the open configuration 138, the controller enclosure 100 may first rotate about the axis 132 in the counter-clockwise direction 188 to the closed configuration 140, such that the cover 112 is oriented in the lateral position 192. Next, with the cover 112 remaining in the lateral position 192, the receptacle 110 may be rotated about the axis 132 in a clockwise direction 238 from the clasping position 214 to the slanted position 184. Accordingly, the rotational motion of the receptacle 110 may expose the control unit 102 supported by the controller enclosure 100 and the work surface 200 of the controller enclosure 100. In order to transition the controller enclosure 100 from the open configuration 138 back to the operational configuration 142, the reverse of the steps described above may be completed.

FIG. 8 is an expanded perspective view of an embodiment of the hinge feature 130 of the controller enclosure 100. More specifically, FIG. 8 illustrates the engagement between the hinge feature 130 and the second support rail 176. It should be appreciated that the hinge feature 130 may engage with the first support rail 170 in a substantially similar manner as the illustrated engagement between the hinge feature 130 and the second support rail 176. However, for conciseness, the engagement between the hinge feature 130 and the second support rail 176 will be discussed below with reference to FIG. 8. Throughout the following discussion, the hinge feature 130 will be referred to as having the pin 160. However, it should be appreciated that the following discussion may also relate to embodiments of the controller enclosure 100 having the pins 166, 172 instead of the pin 160.

With the foregoing in mind, as shown in the illustrated embodiment, the pin 160 may include a shaft portion 240 and a head portion 242 extending therefrom. The shaft portion 240 may be configured to rest in a slot 246 that is formed within the second support rail 176. Accordingly, the second support rail 176 may support the pin 160, while allowing the pin 160 to rotate about the axis 132 relative to the second support rail 176. In some embodiments, the head portion 242 of the pin 160 may include a generally circular cross-section having a diametric dimension that exceeds a width of the slot 246. As a result, the head portion 242 of the pin 160, and the panel 120 of the cover 112 through which the pin 160 extends, may cooperate to limit lateral movement of the controller enclosure 100 along the lateral axis 108 relative to the second support rail 176.

As shown in the illustrated embodiment, the slot 246 may include a first portion 248 that extends in an upward direction 250 along the second support rail 176 and a second portion 252 that extends from the first portion 248 in the transverse direction 154 along the support rail 176. The second portion 252 of the slot 246 may include a receiver section 254 that includes a cross-sectional profile that is geometrically similar to a side-profile of the pin 160 and is marginally larger than the side profile of the pin 160. That is, the receiver section 254 may include a profile that is substantially similar to and marginally larger than a cross-sectional profile of the pin 160 taken along the lateral axis 108. In this manner, the slot 246 may enable removal of the controller enclosure 100 from the support rails 134 without dedicated tools.

For example, to decouple from the support rails 134, the controller enclosure 100 may translate along the first portion 248 of the slot 246 in the upward direction 250, and may subsequently translate along the second portion 252 of the slot 246 in the transverse direction 154. Accordingly, the pin 160 may release from the slot 246 via the receiver section 254, thereby enabling the controller enclosure 100 to decouple from the support rails 134. To re-couple the controller enclosure 100 to the support rails 134, the pin 160 may be aligned with the respective receiver sections 254 of the support rails 134, translated along the second portions 252 of the slots 246 in the reverse direction 185, and subsequently translated along the first portion 248 of the slots 246 in a downward direction 260. In this manner, the slots 246 may enable rapid coupling or decoupling of the controller enclosure 100 from the support rails 134. That is, the slots 246 may be configured to slideably receive the pin 160 to rotatably couple the controller enclosure 100 to the support rails 134 and may be configured to slideably release the pin 160 to decouple the controller enclosure 100 from the support rails 134. The slots 246 may thereby facilitate rapid installation of the controller enclosure 100 within a particular HVAC unit 12, as well as facilitate removal of the controller enclosure 100 from the HVAC unit 12 for maintenance or other purposes.

Although the receptacle 110, the cover 112, and the controller enclosure 100 itself, have been described as rotatable relative to the support rails 134 about the common rotational axis 132, in other embodiments, the receptacle 110 and the cover 112 may be configured to rotate relative to one another about a first rotational axis, while the controller enclosure 100 is configured to rotate relative to the support rails 134 about a second rotational axis. As a non-limiting example, returning to FIG. 5, in some embodiments, first hinge feature(s) 262 may be used to rotatably couple the receptacle 110 to the cover 112 and to enable the receptacle 110 and the cover 112 to rotate relative to one another about a first rotational axis, such the rotational axis 132. Second hinge feature(s) 264 may be used to rotatably couple the cover 112 or the receptacle 110 to the support rails 134. Accordingly, the controller enclosure 100 may be rotatable relative to the support rails 134 about an additional rotational axis, which may be collinear to the axis 132. That is, the second hinge feature 264 may enable the receptacle 110 and the cover 112 to remain stationary relative to one another and to collectively rotate relative to the support rails 134 about the second rotation axis.

As set forth above, embodiments of the present disclosure may provide one or more technical effects useful for reducing or substantially mitigating exposure of the control unit 102 to foreign elements, such as contaminants. In particular, the disclosed controller enclosure 100 is configured to encapsulate the control unit 102 in the closed configuration 140 and, as a result, substantially isolate the control unit 102 from an ambient environment. That is, the control unit 102 may be substantially sealed within the chamber 118 of the receptacle 110 and may be protected from exposure to environmental elements or contaminants that may cause to the control unit 102 to degrade over time. Moreover, the hinge features 130 of the controller enclosure 100 may enable the controller enclosure 100 to rotatably couple to the support rails 134 or decouple from the support rails 134 without the use of fasteners or tools, which may facilitate installation and/or maintenance of the controller enclosure 100. The technical effects and technical problems in the specification are examples and are not limiting. It should be noted that the embodiments described in the specification may have other technical effects and can solve other technical problems.

While only certain features and embodiments of the present disclosure have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the present disclosure. Furthermore, in an effort to provide a concise description of the exemplary embodiments, all features of an actual implementation may not have been described, such as those unrelated to the presently contemplated best mode of carrying out the present disclosure, or those unrelated to enabling the claimed embodiments. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) control system, comprising:

control circuitry configured to manage operation of an HVAC system;

an enclosure including a first portion and a second portion assembled in a clamshell configuration, wherein the first portion and the second portion are configured to hingedly engage in a closed configuration about the control circuitry to encapsulate the control circuitry in an interior volume between the first portion and the second portion and are configured to hingedly disengage into an open configuration to create an opening that exposes the control circuitry to an environment surrounding the enclosure and enables installation and removal of the control circuitry via the opening by a technician; and a hinge feature configured to hingedly couple the enclosure to a housing of the HVAC system.

2. The HVAC control system of claim 1, wherein the first portion and the second portion are each configured to be hingedly coupled to each other and to frame rails of the housing via the hinge feature.

3. The HVAC control system of claim 1, wherein the hinge feature includes a pin configured to couple the first portion and the second portion, such that the first portion and the second portion are configured to rotate relative to one another about the pin.

4. The HVAC control system of claim 1, wherein the control circuitry is communicatively coupled to wiring extending through the enclosure proximate a hinge point between the first portion and the second portion.

5. The HVAC control system of claim 1, wherein the first portion and the second portion are hingedly coupled via an additional hinge feature.

6. The HVAC control system of claim 1, wherein the first portion includes a receptacle and the second portion includes a cover configured to create a sealing engagement with the receptacle in the closed configuration.

7. The HVAC control system of claim 6, wherein the receptacle is configured to receive the control circuitry via the opening while the enclosure is in the open configuration.

8. The HVAC control system of claim 1, wherein the first portion includes a first base portion with a first set of walls disposed around the first base portion to form a first case, and the second portion includes a second base portion with a second set of walls disposed around the second base portion to form a second case.

9. The HVAC control system of claim 8, wherein, in the closed configuration of the first portion and the second portion, the first set of walls is configured to be received within the second set of walls.

10. The HVAC control system of claim 9, comprising a gasket disposed within the enclosure, wherein, in the closed configuration of the first portion and the second portion, the first set of walls is configured to compress the gasket against the second portion to seal the interior volume and the control circuitry from the environment surrounding the enclosure.

11. The HVAC control system of claim 1, wherein the hinge feature is configured to couple with vertical supports of the housing, and wherein the first portion and the second portion are configured to rotate about the hinge feature while in the closed configuration to provide a work surface atop the first portion that extends in a direction transverse to the vertical supports of the housing.

12. The HVAC control system of claim 1, wherein the hinge feature is configured to couple with vertical supports of the housing, and wherein the first portion and the second portion are configured to rotate about the hinge feature in a first direction while in the closed configuration to an orientation transverse to the vertical supports of the housing, and wherein the first portion is configured to further rotate about the hinge feature in a second direction, opposite to the first direction, to provide a work surface within the second portion that extends in the orientation transverse to the vertical supports of the housing.

13. An enclosure for a control board of a heating, ventilation, and/or air conditioning (HVAC) system, comprising:

a receptacle having a chamber configured to receive the control board; and a cover and a hinge feature, wherein the hinge feature pivotably couples the receptacle to the cover, wherein the receptacle and the cover are configured to pivotably engage in a closed configuration to enclose the control board and seal the control board within the chamber such that the control board is shielded from an environment surrounding the enclosure and are configured to pivotably disengage to an open configuration to expose the control board to the environment, wherein the hinge feature is configured to pivotably couple with frame rails of the HVAC system to enable pivotal motion of the enclosure relative to the frame rails about a first axis, and wherein the hinge feature is configured to engage with and translate along the frame rails to enable translational movement of the enclosure relative to the frame rails along a second axis cross-wise to the first axis.

14. The enclosure of claim 13, wherein the receptacle includes a base portion and a set of walls extending from a perimeter of the base portion to form the chamber.

15. The enclosure of claim 14, wherein the base portion is a first base portion, the set of walls is a first set of walls, and wherein the cover includes a second base portion and a second set of walls extending from the second base portion, wherein the first set of walls of the receptacle is configured to be received within the second set of walls of the cover and engage with the second base portion of the cover in the closed configuration to form a fluid seal between the first set of walls and the second base portion.

16. The enclosure of claim 14, wherein the control board is coupled to the base portion.

17. The enclosure of claim 13, wherein the hinge feature includes a pin that is configured to extend between the frame rails of the HVAC system.

18. A heating, ventilation, and/or air conditioning (HVAC) unit, comprising:

a control board configured to manage operation of the HVAC unit;

an enclosure including a receptacle configured to receive and support the control board and including a cover hingedly coupled to the receptacle, wherein the receptacle and the cover are configured to rotate relative to one another between a closed configuration to encapsulate the control board within an interior volume between the receptacle and the cover and an open configuration to expose the control board to an environment surrounding the enclosure;

frame rails configured to support the enclosure, wherein the frame rails comprise guide slots formed therein; and a hinge feature configured to hingedly couple the enclosure to the frame rails, wherein the hinge feature enables the enclosure to pivot about a first axis relative to the frame rails, and wherein the guide slots enable the hinge feature and the enclosure to translate along a second axis relative to the frame rails, wherein the first axis is cross-wise to the second axis.

19. The HVAC unit of claim 18, wherein the receptacle and the cover are hingedly coupled to one another via the hinge feature.

20. The HVAC unit of claim 19, wherein the hinge feature comprises one or more pins configured to engage with the guide slots, wherein the guide slots are configured to slideably receive the one or more pins and support the one or more pins to hingedly couple the enclosure to the frame rails, and the guide slots are configured to slideably release the one or more pins to decouple the enclosure from the frame rails.

21. The HVAC unit of claim 18, wherein the enclosure is configured to rotate about the hinge feature between a transverse position where the enclosure extends cross-wise to the frame rails and a streamlined position where the enclosure is generally aligned with the frame rails.

22. The HVAC unit of claim 21, wherein the cover includes a set of flanges formed integrally therein and extending from the cover, wherein the set of flanges is configured to engage with the frame rails in the streamlined position of the enclosure to couple the enclosure to the frame rails.

23. The HVAC unit of claim 18, wherein the receptacle and the cover are configured to rotate relative to one another about the first axis, and the enclosure is configured to rotate relative to the frame rails about the first axis when the receptacle and the cover are in the closed configuration.

24. The HVAC unit of claim 18, wherein the control board is communicatively coupled to the HVAC unit via wiring extending through openings formed within the receptacle, wherein the openings are positioned proximate the hinge feature.

25. The HVAC control system of claim 1, comprising a compression feature coupled to the enclosure, wherein the compression feature is configured to apply and retain a compressive force between the first portion and the second portion in the closed configuration of the first portion and the second portion.

26. The HVAC control system of claim 1, comprising a support configured to engage the second portion in the open configuration of the enclosure to support the second portion in a working position in which the second portion provides access to a working surface of the second portion, wherein, in the open configuration of the enclosure, the first portion is configured to suspend the control circuitry above the working surface, and wherein the working surface is configured to support equipment for installation, maintenance, and/or inspection of the control circuitry via the opening.

* * * * *